US006479450B1

(12) United States Patent
Weiss et al.

(10) Patent No.: US 6,479,450 B1
(45) Date of Patent: Nov. 12, 2002

(54) BLEACHING SYSTEM

(75) Inventors: Albrecht Weiss, Langenfeld (DE); Ulrich Pegelow, Duesseldorf (DE); Beatrix Kottwitz, Duesseldorf (DE); Marita Grothus, Friedberg (DE); Maria Liphard, Essen (DE)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 09/424,610

(22) PCT Filed: May 18, 1998

(86) PCT No.: PCT/EP98/02920

§ 371 (c)(1),
(2), (4) Date: Feb. 2, 2000

(87) PCT Pub. No.: WO98/54282

PCT Pub. Date: Dec. 3, 1998

(30) Foreign Application Priority Data

May 26, 1997 (DE) ..... 197 21 886

(51) Int. Cl.[7] ..... C11D 3/26; C11D 3/395; C11D 3/386

(52) U.S. Cl. ..... 510/303; 510/305; 510/311; 510/320; 510/321; 510/372; 510/376; 510/392; 510/393

(58) Field of Search ..... 510/303, 305, 510/311, 320, 321, 372, 376, 392, 393; 252/186.33; 8/111

(56) References Cited

U.S. PATENT DOCUMENTS

| | | | | |
|---|---|---|---|---|
| 4,119,557 A | | 10/1978 | Postlethwaithe | 252/99 |
| 4,246,612 A | | 1/1981 | Berry et al. | 358/206 |
| 4,430,243 A | | 2/1984 | Bragg | 252/91 |
| 4,601,845 A | | 7/1986 | Mamnath | 252/99 |
| 4,626,373 A | | 12/1986 | Finch et al. | 252/96 |
| 4,711,748 A | | 12/1987 | Irwin et al. | 264/117 |
| 4,728,455 A | | 3/1988 | Rerek | 252/99 |
| 5,114,611 A | | 5/1992 | Jankralingen et al. | 252/186.33 |
| 5,194,416 A | | 3/1993 | Jureller et al. | 502/167 |
| 5,227,084 A | | 7/1993 | Martens et al. | 252/95 |
| 5,244,594 A | | 9/1993 | Favre et al. | 252/186.33 |
| 5,246,621 A | | 9/1993 | Favre et al. | 252/186.33 |
| 5,288,746 A | | 2/1994 | Pramond | 252/95 |
| 5,574,003 A | | 11/1996 | Johnston | 510/301 |
| 5,895,765 A | * | 4/1999 | Rheinheimer et al. | 436/514 |
| 6,030,933 A | * | 2/2000 | Herbots et al. | 510/392 |

FOREIGN PATENT DOCUMENTS

| | | | |
|---|---|---|---|
| CA | 866 191 | | 3/1971 |
| DE | 20 64 146 | | 7/1971 |
| DE | 20 54 019 | | 10/1971 |
| DE | 195 26 905 | | 2/1997 |
| EP | 0 224 952 | | 10/1987 |
| EP | 0 244 920 | | 11/1987 |
| EP | 0 306 089 | | 3/1989 |
| EP | 0 408 131 | | 1/1991 |
| EP | 0 458 397 | | 11/1991 |
| EP | 0 458 398 | | 11/1991 |
| EP | 537381 | * | 4/1993 |
| EP | 0 537 381 | | 4/1993 |
| EP | 0 544 519 | | 6/1993 |
| EP | 0 549 272 | | 6/1993 |
| EP | 0 553 607 | | 8/1993 |
| EP | 0 553 608 | | 8/1993 |
| EP | 0 630 694 | | 12/1994 |
| EP | 0 384 503 | | 8/1995 |
| EP | 0 693 550 | | 1/1996 |
| EP | 0 717 103 | | 6/1996 |
| WO | WO9315174 | | 8/1993 |
| WO | WO95/07972 | | 3/1995 |
| WO | WO96/06157 | | 2/1996 |
| WO | WO 97/07192 | * | 2/1997 |

OTHER PUBLICATIONS

Inorganic Chemistry, 21 (1982) pp. 3086–3090.
Inorganic Chemistry, 24 (1985) pp. 1230–1235.
J. Chem. Soc., (1987) pp. 886.
Macromolecules, 27 (1994) pp. 1291–1296.
ROMPP Biotechnologie, p. 388.
Industriell Enzyme (1994) pp. 728–757.
Industrial Enzmology, 2 (1994) pp. 269–272.

* cited by examiner

*Primary Examiner*—Gregory Delcotto
(74) *Attorney, Agent, or Firm*—Stephen D. Harper; Glenn E. J. Murphy

(57) ABSTRACT

A bleaching composition is presented having a) an enzyme which produces hydrogen peroxide from atmospheric oxygen, b) a substrate for said enzyme, and c) a transition metal compound, where the enzyme is covalently bound to the transition metal compound. The bleaching composition is useful in disinfectants and laundry detergents as a bleaching component and for inhibiting the transfer of dyes.

19 Claims, No Drawings

BLEACHING SYSTEM

BACKGROUND OF THE INVENTION

1. Field of the Invention

This application is filed under 35 U.S.C. 371 and based on PCT/EP98/02920, filed May 1998, 1998.

This invention relates to a bleaching system of an enzyme which produces hydrogen peroxide and a transition metal compound and to the use of this system as a bleaching component in detergents.

2. Discussion of Related Art

Enzymatic bleaching compositions which contain a hydrogen peroxide generating system are known from the prior art and are described, for example, in patent applications EP 553 608, EP 553 607, EP 538 228, EP 537 381 and DE 20 64 146.

Enzymatic bleaching compositions of the type in question may be used, for example, in laundry detergents formulated to develop a good bleaching effect at low temperatures. In the wash liquor, the enzymes catalyze the reaction between the dissolved oxygen and the substrate.

A bleach activator is normally used in order to obtain a good bleaching effect at low temperatures, for example between 15 and 55° C. One of the most commonly used bleach activators is tetraacetyl ethylenediamine (TAED) which forms peracetic acid by reacting with the hydrogen peroxide, the peracetic acid being the actual bleaching agent.

So far as the use of such bleach-containing enzymatic surfactant compositions is concerned, however, it is important that they contain little or no catalase because catalase catalyzes the decomposition of the hydrogen peroxide formed by the enzyme. Accordingly, the oxidase and also other enzymes in the system should be carefully purified which considerably increases the costs of the enzymes.

Oxidases are used in low concentrations for economic reasons. However, low oxidase or peroxidase concentrations also lead to the formation of less hydrogen peroxide and hence to a poor bleaching effect. Bleach catalysts in the form of transition metal complexes, for example of manganese (Mn) and/or iron (Fe), are known from the prior art and are described, for example, in European patent applications EP 0 458 397, EP 0 458 398, EP 0 544 519 and EP 0 549 272. In combination with hydrogen peroxide, they form a very powerful oxidation system.

Unfortunately, these transition metal complexes have the disadvantage that they destroy not only the bleachable soils, but also the dye present on the fibers. In some cases, they can even destroy the fibers themselves, resulting in so-called pitting.

The problem addressed by the present invention was to provide a catalyst system which would be effective at low temperatures without the external addition of oxygen carriers and which would react with bleachable soils present on the fibers or in the wash liquor, thus leading to the destruction of the soils. Although the bleaching system would react with free dye molecules present in the wash liquor, the color on the fabric would remain intact, i.e. reaction with the dye present on the fibers or with the fibers themselves would be avoided.

DESCRIPTION OF THE INVENTION

Accordingly, the present invention relates to a bleaching system of an enzyme which produces hydrogen peroxide and a transition metal compound, characterized in that an enzyme producing hydrogen peroxide from atmospheric oxygen and a suitable enzyme substrate is covalently bound to the transition metal compound.

Accordingly, the present invention also relates to the use of the bleaching system as a bleaching component in detergents and for inhibiting the transfer of dyes in the use of the detergents. The invention also relates to the use of the bleaching systems in disinfectants.

It has surprisingly been found that very good bleaching results are obtained at low washing temperatures, more especially between 15 and 55° C., with the bleaching system according to the invention. The bleaching system continuously forms $H_2O_2$ and thus develops a uniform bleaching effect without causing any fiber damage. Although it reacts with the bleachable soils on the fibers and in the wash liquor and also with free dye molecules present in the wash liquor, it does not react with textile dyes present on the fibers.

At relatively high temperatures, the system is substantially inactive in view of the thermal lability of enzymes. By virtue of the high solubility of the enzymatic system according to the invention, deposits on fibers can be minimized. No deposits of the metal complex bound to the enzyme on items of laundry were observed.

The transition metal compounds used in enzyme-bound form in accordance with the invention are preferably copper, manganese, iron, cobalt, ruthenium and/or molybdenum compounds because the bleaching reaction can be controlled particularly well within certain limits with these compounds.

Examples of such bleach catalyst compounds are the manganese complexes described in U.S. Pat. Nos. 5,246,621 and 5,244,594. Preferred examples of these complexes are $Mn\text{-}^{IV}{}_2(\mu\text{-}O)_3$(1,4,7-trimethyl-1,4,7-triazacyclononane)$_2$-$(PF_6)_2$, $Mn^{III}{}_2(\mu\text{-}O)_1(\mu\text{-}OAc)_2$(1,4,7-trimethyl-1,4,7-triazacyclononane)$_2$-$(ClO_4)_2$, $Mn\text{-}^{IV}{}_4(\mu\text{-}O)_6$(1,4,7-triazacyclononane)$_4$-$(ClO_4)_2$, $Mn^{III}Mn^{IV}{}_4(\mu\text{-}O)_1(\mu\text{-}OAc)_2$-(1,4,7-trimethyl-1,4,7-triazacyclononane)$_2$-$(CiO_4)_3$ and mixtures thereof. Other examples of transition metal compounds can be found in European patent application EP 0 549 272.

Other suitable compounds contain 1,5,9-trimethyl-1,5,9-triazacyclododecane, 2-methyl-1,4,7-triazacyclononane, 2-methyl-1,4,7-triazacyclononane, 1,2,4,7-tetramethyl-1,4,7-triazacyclononane and mixtures thereof as ligands.

Other suitable transition metal compounds are described in U.S. patents U.S. Pat. No. 4,246,612 and U.S. Pat. No. 5,227,084.

Mononuclear manganese(IV) complexes, such as Mn(1,4,7-trimethyl-1,4,7-triazacyclononane)$(OCH_3)_3$-$(PF_6)$, are disclosed in US patent U.S. Pat. No. 5,194,416.

Also suitable are water-soluble manganese(II), manganese(III) and manganese(IV) complexes, in which the ligand is a carboxylate polyhydroxy compound containing at least three successive C—OH groups, such as compounds with sorbitol, iditol, dulcitol, mannitol, xylitol, arabitol, adonitol, meso-erythritol, meso-inositol, lactose and mixtures thereof as ligands.

A suitable transition metal complex containing Mn, Co, Fe or Cu as transition metals and a non(macro)cyclic ligand is described in US patent U.S. Pat. No. 5,114,611. The ligand has the following general formula:

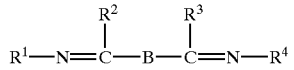

(I)

in which $R^1$, $R^2$, $R^3$ and $R^4$ may be selected from H, substituted alkyl and aryl groups, so that each $R^1$—N=C—$R^2$ and $R^3$—C=N=$R^4$ forms a 5-membered or 6-membered ring. This ring may be substituted. B is a bridge-forming group of O, S, $CR^5R^6$, $NR^7$ and C=O, where $R^5$, $R^6$ and $R^7$ may be hydrogen, substituted or unsubstituted alkyl or aryl groups. Preferred ligands are pyridine, pyridazine, pyrimidine, pyrazine, imidazole, pyrazole and triazole rings. The rings may optionally be substituted by such substituents as alkyl, aryl, alkoxy, halogen and nitro. A particularly preferred ligand is 2,2'-bis-pyridylamine. Of the transition metal complexes described in U.S. Pat. No. 5,114,611, Co—, Cu—, Mn—, Fe-bis-pyridylmethane and bis-pyridylamine complexes are preferred. Co(2,2'-bis-pyridylamine) $Cl_2$, di(isothiocyanato) bis-pyridylamine-cobalt(II), tris-dipyridylamine-cobalt (II) perchlorate, Co(2,2-bis-pyridylamine)$_2O_2ClO_4$, bis-(2,2'-bis-pyridylamine) copper(II)perchlorate, tris-(di-2-pyridylamine)-iron(II) perchlorate and mixtures thereof are most particularly preferred. Other examples are Mn glyconate, $Mn(CF_3SO_3)_2$, $Co(NH_3)_5Cl_3$ and binuclear Mn complexes with tetra-N-dentate and bi-N-dentate ligands, such as $N_4Mn^{III}(\mu\text{-}O)_2Mn^{IV}{}_4)^+$ and $[Bipy_2Mn^{III}(\mu\text{-}O)_2Mn^{IV}Bipy_2]\text{-}(ClO_4)_3$.

Other bleach catalysts are described, for example, in European patent applications EP 0 408 131 (catalysts based on cobalt complexes), EP 0 384 503 and EP 0 306 089 (metal porphyrin catalysts), in US patent U.S. Pat. No. 4,728,455 (manganese catalysts with polydentate ligands), US patent U.S. Pat. No. 4,711,748 and European patent application EP 0 224 952 (manganese absorbed on alumosilicate), in US patent U.S. Pat. No. 4,601,845 (alumosilicate support with manganese and zinc or magnesium salt), US patent U.S. Pat. No. 4,626,373 (manganese/ligand catalyst), US patent U.S. Pat. No. 4,119,557 (iron complex catalyst), German patent DE 20 54 019 (cobalt chelate catalyst), Canadian patent CA 866 191 (salts containing transitional metals), US patent U.S. Pat. No. 4,430,243 (chelate complexes with manganese cations and non-catalytic metal cations) and US patent U.S. Pat. No. 4,728,455 (manganese gluconate catalysts).

Other suitable transition metal compounds are complex compounds which contain as ligand a macrocyclic organic compound corresponding to formula (II):

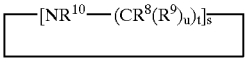

(II)

in which t is an integer of 2 or 3, s is an integer of 3 or 4 and u is 0 or 1, $R^8$, $R^9$ and $R^{10}$ independently of one another are selected from the group consisting of H, alkyl, aryl, substituted alkyl or aryl.

The ligands mentioned above can be prepared by known methods which are described, for example, by K. Wieghardt et al. in Inorganic Chemistry 1982, 21, pages 3086 et seq.

Another preferred ligand L contains two ligands corresponding to formula (III):

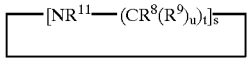

(III)

in which t, s, u, $R^8$ and $R^9$ each have the meanings defined above and $R^{11}$ is selected from hydrogen, alkyl, aryl, substituted alkyl and substituted aryl, with the proviso that at least one bridge-forming unit $R^{12}$ is formed by an $R^{11}$ unit from each ligand, $R^{12}$ being the group $(CR^{13}R^{14})_n$—$D_p$ $(CR^{13}R^{14})_m$, where p is 0 or 1, D is selected from a hetero atom, such as oxygen, and $NR^{15}$ or is part of an optionally substituted aromatic or saturated, mononuclear or heteronuclear ring and, where n is an integer of 1 to 4, m is an integer of 1 to 4, with the proviso that n+m<4, $R^{13}$ and $R^{14}$ independently of one another being selected from H, $R^{16}$ and $OR^{17}$, alkyl, aryl, substituted alkyl and substituted aryl and each of $R^{15}$, $R^{16}$ and $R^{17}$ being independently selected from hydrogen, alkyl, aryl, substituted alkyl and substituted aryl.

One example of a preferred ligand of this type is 1,2-bis-(4,7-dimethyl-1,4,7-triaza-1-cyclononyl)-ethane, ([EB $(Me_3TACN)_2$]).

The ligands mentioned above may be prepared as described by K. Wieghardt et al. in Inorganic Chemistry, 1985, 24, pages 1230 et seq. and in J. Chem. Soc. Chem. Comm., 1987, page 886, or by simple modifications of this synthesis.

The ligands may also be in the form of their acid salts, such as the HCl or $H_2SO_4$ salts, for example in the form of 1,4,7-$Me_3$TACN hydrochloride. The iron and/or manganese ions may also be added separately or in a single product together with the ligand.

The iron or manganese ions may be present in the form of a water-soluble salt, such as iron or manganese nitrate, chloride, sulfate or acetate, or in the form of a co-ordination compound, such as manganese acetyl metal complex can be quickly formed are preferably used.

In another embodiment, the bleach catalyst may also be present in the form of mono-, bi- or tetranuclear manganese or iron complexes. Preferred mononuclear complexes correspond to general formula (IV):

$$[LMnX_p]^ZY_q \qquad \text{(VI)}$$

in which Mn is manganese with the oxidation number II, III or IV, X is a coordination ligand which may be independently selected from OR", where R" is a $C_{1-20}$ moiety selected from the group consisting of alkyl, cycloalkyl, aryl, benzyl and combinations thereof, this moiety optionally being substituted, or at least two substituents R" can be attached to one another to form a bridge member between the two oxygen atoms which are attached to the manganese, $Cl^-$, $Br^-$, $I^-$, $F^-$, NCS—, $N_3^-$, $I_3^-$, NH" OH—, $O_2^{2-}$, $HOO^-$, $H_2O$, SH, $CN^-$, $OCN^-$, $SO_4^{2-}$, $R^{18}COO^-$, $R^{18}SO_4^{2-}$, $RSO_3^-$ and $R^{18}CO^-$, where $R^{18}$ is selected from hydrogen, alkyl, aryl, substituted alkyl and substituted aryl and $R^{19}COO$, where $R^{19}$ is selected from alkyl, substituted alkyl and substituted aryl, P is an integer of 1 to 3, Z represents the charge of the complex and is an integer which may be positive, zero or negative, Y is a monovalent or polyvalent counterion which leads to charge neutrality, the type of this counterion being dependent on the charge z of the complex, q=z/[charge Y], and L is a ligand corresponding to formula (I) as defined above.

In addition, these mononuclear complexes are described in European patent applications EP 0 544 519 and EP 0 549 272.

Preferred polynuclear complexes correspond to formulae V and VI below:

(V)

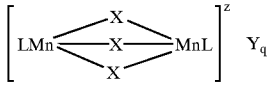

(VI)

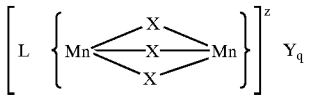

where the Mn's independently of one another have the oxidation numbers III or IV and L, X, Y, z and q have the meanings defined for formulae I to III.

Particularly preferred binuclear manganese complexes are those in which X is independently selected from $CH_3COO^-$, $O_2^{2-}$ and $O^{2-}$ and, in a particularly preferred embodiment, those in which the manganese is present with the oxidation number IV and X represents $O^{2-}$. Examples of such ligands are:

i) $[Mn^{IV}_2\ (\mu\text{-}O)_3\ (1,4,7\text{-}Me_3TACN)_2]\ (PF_6)_2$ ii) $[Mn^{IV}_2\ (\mu\text{-}O)_3\ (1,2,4,7\text{-}Me_4TACN)_2]\ (PF_6)_2$ iii) $[Mn^{III}_2\ (\mu\text{-}OAc)_2\ (\mu\text{-}O)\ (1,4,7\text{-}Me_3TACN)_2]\ (PF_6)_2$ iv) $[Mn^{III}_2\ (\mu\text{-}O)(\mu\text{-}OAc)_2\ (1,2,4,7\text{-}Me_4TACN)_2]\ (PF_6)_2$ v) $[Mn^{IV}_2\ (\mu\text{-}O)_2\ (\mu\text{-}O)_2\ (1,4,7\text{-}Me_3TACN)_2]\ (PF_6)_2$ vi) $[Mn^{IV}Mn^{III}\ (\mu\text{-}O)_2\ (\mu\text{-}OAc)(EB\text{-}(Me_3TACN)_2)]\ (PF_6)_2$ and other complexes with other counterions than $SO_2^{2-}$, $ClO_{4-}$, etc.

Other binuclear complexes of this type, their production and use are described in detail in European patent applications EP 0 458 397 and EP 0 458 398.

One example of a tetranuclear complex is:

$$[Mn^{IV}_4\ (\mu\text{-}O)_6\ (TACN)_4]\ (ClO_4)_4$$

Other suitable transition metal complexes are the so-called salen complexes corresponding to formula (VII):

(VII)

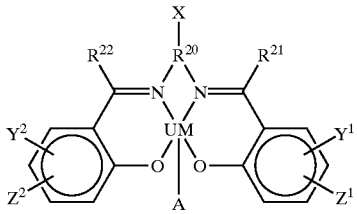

in which

UM stands for manganese, iron, cobalt, ruthenium or molybdenum, $R^{20}$ is an alkylene, alkenylene, phenylene or cycloalkylene group which, in addition to the substituent X, may optionally be alkyl- and/or aryl-substituted with a total of 1 to 12 carbon atoms, the shortest distance between the N atoms complexing with UM in $R^{20}$ being 1 to 5 carbon atoms.

X represents —H, —$OR^{23}$, —$NO_2$, —F, —Cl, —Br or —I, $R^{21}$, $R^{22}$ and $R^{23}$ independently of one another represent hydrogen or an alkyl group containing 1 to 4 carbon atoms, $Y^1$ and $Y^2$ independently of one another represent hydrogen or an electron-shifting substituent, $Z^1$ and $Z^2$ independently of one another represent hydrogen, —$CO_2M$, —$SO_3M$ or —$NO_2$, M is hydrogen or an alkali metal, such as lithium, sodium or potassium, and A is a charge-equalizing anion ligand.

Preferred compounds corresponding to formula (VII) are those in which $R^{20}$ is a methylene group, a 1,2-ethylene group, a 1,3-propylene group, a 2-hydroxy- or -nitro-substituted 1,3-propylene group, a 1,2-cycloalkylene group containing 4 to 6 carbon atoms, more especially a 1,2-cyclohexylene group, or an o-phenylene group.

The electron-shifting substituents $Y^1$ and $Y^2$ in formula (VII) include the hydroxy group, alkoxy groups containing 1 to 4 carbon atoms, aryloxy groups, the nitro group, halogen atoms, such as fluorine, chlorine, bromine and iodine, the amino group which may even be mono- or dialkylated or mono- or diarylated, linear or branched alkyl groups containing 1 to 4 carbon atoms, cycloalkyl groups containing 3 to 6 carbon atoms, linear or branched alkenyl groups containing 2 to 5 carbon atoms and aryl groups which in turn may bear the substituents mentioned above. The alkenyl groups which may contain one or two C—C double bonds preferably contain at least one double bond in conjugation with the benzene ring. Preferred alkenyl substituents are the allyl group and the vinyl group. The substituents $Y^1$ and $Y^2$ are preferably in the 5-position. Preferred compounds (VII) include those in which $Y^1$ and $Y^2$ are the same.

The alkyl groups containing 1 to 4 carbon atoms, more particularly $R^1$, $R^2$ and $R^3$, include in particular the methyl, ethyl, n-propyl, isopropyl, n-butyl, sec.butyl, isobutyl and tert.butyl group.

The charge-equalizing anion ligand A in the compounds corresponding to formula (VI) may be monovalent or polyvalent; in the latter case, it may correspondingly neutralize several transition metal atoms containing the organic ligands mentioned. It is preferably a halide, more especially a chloride, a hydroxide, hexafluorophosphate, perchlorate or the anion of a carboxylic acid, such as formate, acetate, benzoate or citrate.

The compounds of formula (VII) used in accordance with the invention may be prepared in known manner by reacting salicylaldehyde or corresponding ketones (where $R^{21}$ and/or $R^{22}$ is/are not hydrogen), which optionally bear the above-defined substituents $Y^1$ and $Y^2$, $Z^1$ and/or $Z^2$, with diamines $H_2N$—$R^{20}$—$NH_2$ and reacting the salen ligand obtainable in this way with transition metal salts as described, for example, in European patent application EP 0 630 694 or by B. B. De, B. B Lohraj, S. Sivaram and P. K. Dhal in Macromolecules 27 (1994), 1291–1296.

The enzyme base for the enzymatic hydrogen peroxide generating system according to the invention may be selected from various such systems which are already known from the prior art. For example, an amine oxidase and an amine, an aminoacid oxidase and an amino acid, cholesterol oxidase and cholesterol uric acid-U-oxidase and uric acid or xanthine oxidase and xanthine may be used.

However, combinations of a $C_{1-4}$ alkanol oxidase, glucose oxidase, choline oxidase and a corresponding alkanol are preferred, ethanol oxidase and ethanol and glucose oxidases active in alkaline medium being particularly preferred. Preferred ethanol oxidases are those isolated from a catalase-negative strain of Hansenula polymorpha (see for example EP 0 244 920), One preferred embodiment is characterized by the use of enzymes fixed to supports. The enzymes may be fixed to supports of any kind in known manner. Suitable support materials are, for example, active carbon, aluminium oxide, titanium-activated glass, synthetic resins, silica gel, glasses, cellulose and cellulose derivatives, starch derivatives, wood chips, silicon dioxide or organic polymers, such as polyurethanes etc.

According to the invention, the transition metal complex is bound to the enzyme by a covalent bond. The covalent bond is established through reactive groups which are present at the surface of the enzymes and in the complex ligands. Reactive functional groups at the surface of the enzymes are, for example, a- and E-amino groups, carboxy, hydroxy and sulfhydryl, imidazole and phenolic groups, amino groups, hydroxy groups and sulfhydryl groups being particularly suitable. Should the enzymes used not have any of these groups, the surface may be modified in known manner by protein engineering, for example by replacing suitable amino acids at the surface of the enzymes to introduce correspondingly functionalized amino acids to which the metal complex may be covalently bound. The reactive groups at the surface of the enzymes are directly attached to suitable reactive groups in the transition metal complex. Particularly suitable reactive groups in the transition metal complex are OH—, $NH_2$—, COOH— and (—S—)— groups, $NH_2$— and COOH— groups being preferred. The enzyme and the transition metal complex may be linked by methods known from the enzyme technology for immobilizing enzymes (cf. Römpp, Biotechnologie, page 388, keyword: Immobilisierung, with other literature references; "Industrielle Enzyme", Heinz Ruttloβ, 1994, Behr's Verlag; "Industrial Enzymology", 2nd Edition, 1994, pages 269–272, Godfrey & West. The enzyme and the metal complex may optionally be used in a form in which they are attached via a so-called spacer of the type also used in enzyme immobilization.

In one preferred embodiment, the bleaching system according to the invention of oxidase and metal compound has a surface charge which is positive in the vicinity of the metal compound. Dimerization via metal compounds can be prevented by such a charge distribution. In addition, the binding or accumulation of the bleachable soils can be improved in this way.

In another preferred embodiment of the present invention, the surface of the enzyme is modified in known manner by protein engineering. In this way, it is possible on the one hand to stabilize the compound and thus to prevent dimerization or further aggregations and, on the other hand, to optimize bleaching of the bleachable soils, more particularly the specificity to soil with fabric care in mind.

The present invention also relates to the use of the bleaching system described in the foregoing as a bleaching component in detergents, more particularly in heavy-duty laundry detergents, and for inhibiting the transfer of dyes during washing.

These detergents may contain any of the components typically encountered in detergents as further components, including for example anionic, nonionic, cationic and amphoteric surfactants, inorganic and organic builders, auxiliaries, such as optical brighteners, redeposition inhibitors, salts, etc.

The present invention also relates to a detergent containing the bleaching system claimed in any of claims 1 to 7. The bleaching system consisting of derivatized enzyme and enzyme substrate may be present in the detergents in a quantity of 0.1% by weight to 20% by weight, based on the detergent as a whole.

What is claimed is:

1. A bleaching composition comprising:

a) an enzyme which produces hydrogen peroxide from atmospheric oxygen;

b) a substrate for said enzyme; and c) a transition metal compound, wherein said enzyme is covalently bound to said transition metal compound.

2. The bleaching composition of claim 1 comprising a $C_{1-4}$ alkanol oxidase, glucose oxidase, or choline oxidase as the enzyme and a corresponding alkanol as the substrate.

3. The bleaching composition of claim 2 comprising ethanol oxidase and ethanol.

4. The bleaching composition of claim 2 comprising a glucose oxidase that is active in an alkaline medium.

5. The bleaching composition of claim 1 comprising a transition metal compound comprising copper, manganese, iron, cobalt, ruthenium, molybdenum, or mixtures thereof.

6. The bleaching composition of claim 1 wherein the transition metal compound comprises a ligand comprising a macrocyclic organic compound corresponding to formula (II):

$$[NR^{10}—(CR^8(R^9)_u)_t]_s \quad \text{(II)}$$

in which t is an integer of 2 or 3, s is an integer of 3 or 4 and u is 0 or 1, and $R^8$, $R^9$ and $R^{10}$ independently of one another are selected from the group consisting of H, alkyl, aryl, substituted alkyl or aryl.

7. The bleaching composition of claim 1, wherein the transition metal compound comprises at least one salen complex corresponding to formula (VII):

(VII)

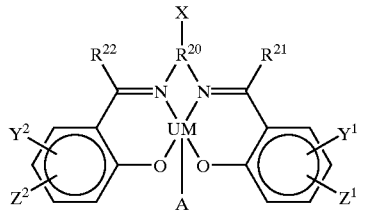

wherein

UM is manganese, iron, cobalt, ruthenium or molybdenum, $R^{20}$ is an alkylene, alkenylene, phenylene or cycloalkylene group which, in addition to the substituent X, the shortest distance between the N atoms complexing with UM in $R^{20}$ being 1 to 5 carbon atoms, X is —H, —$OR^{23}$, —$NO_2$, —F, —Cl, —Br or —I, $R^{21}$, $R^{22}$ and $R^{23}$ independently of one another are hydrogen or an alkyl group containing 1 to 4 carbon atoms, $Y^1$ and $Y^2$ independently of one another are hydrogen or an electron-shifting substituent, $Z^1$ and $Z^2$ independently of one another are hydrogen, —$CO_2M$, —$SO_3M$ or —$NO_2$, M is hydrogen or an alkali metal, and A is a charge-equalizing anion ligand.

8. The bleaching composition of claim 7 wherein $R^{20}$ and/or X is an alkyl- and/or aryl-substituted group with 1 to 12 carbon atoms.

9. The bleaching composition of claim 1 wherein the transition metal compound comprises a manganese or iron complex.

10. The bleaching composition of claim 1 wherein the enzyme is fixed to a support.

11. The bleaching composition of claim 1 wherein the transition metal compound is bound to the enzyme via reactive groups present at the surface of the enzyme.

12. The bleaching composition of claim 6 wherein the transition metal compound is bound to the enzyme via α- and ε-amino groups, carboxy, hydroxy and sulfhydryl, imidazole or phenolic groups.

13. The bleaching composition of claim 1 wherein the surface of the enzyme is modified by protein engineering.

14. The bleaching composition of claim 1 wherein the surface of the enzyme has a positive surface charge at the place where the transition metal compound is bound to the enzyme.

15. A detergent composition comprising the bleaching composition of claim 1.

16. The detergent composition of claim 15 comprising 0.1 to 20 percent by weight of said bleaching composition.

17. A disinfectant composition comprising the bleaching composition of claim 1.

18. A method for bleaching bleachable soils and inhibiting the transfer of dyes comprising forming the detergent of claim 15 and adding said detergent to a wash liquor.

19. The method of claim 18 wherein the temperature of the wash liquor is from 15 to 55° C.

* * * * *